United States Patent [19]

Crespin et al.

[11] 4,377,938

[45] Mar. 29, 1983

[54] DEVICE FOR COOLING THE COMPRESSOR OF A THERMAL MACHINE

[75] Inventors: Joël Crespin; Adrien Grollier-Baron; Daniel Drevet, all of La Verpilliere, France

[73] Assignee: l'Unite Hermetique, France

[21] Appl. No.: 333,882

[22] Filed: Dec. 23, 1981

[51] Int. Cl.[3] ..... F25D 17/02

[52] U.S. Cl. ..... 62/434; 62/469; 62/505; 62/513; 165/104.28

[58] Field of Search ..... 62/505, 434, 513, 469; 165/104.21, 104.28

[56] References Cited

U.S. PATENT DOCUMENTS

| | | | |
|---|---|---|---|
| 2,249,882 | 7/1941 | Buchanan | 62/505 |
| 2,300,005 | 10/1942 | Philipp | 62/469 |
| 2,476,764 | 7/1949 | Philipp | 62/469 |
| 2,518,621 | 8/1950 | Hull et al. | 123/41.21 |
| 2,844,129 | 7/1958 | Beck, Jr. et al. | 123/41.21 |
| 3,246,482 | 4/1966 | Harnish | 62/513 |
| 4,138,862 | 2/1979 | Muller | 62/434 |

FOREIGN PATENT DOCUMENTS

| | | |
|---|---|---|
| 703840 | 2/1941 | Fed. Rep. of Germany . |
| 2298775 | 8/1976 | France . |
| 2372404 | 6/1978 | France . |

*Primary Examiner*—Ronald C. Capossela

[57] ABSTRACT

The invention provides a device for cooling refrigerator or heat pump compressors and more particularly a means for priming the device of the thermo-siphon type which consists in providing a thermal connection between the outlet pipe for the hot gases of the compressor and the outlet pipe for the cooling fluid of this compressor. Ther thermo-siphon for cooling the compressor is thus primed as soon as this latter is started up and improves the efficiency of refrigerators or heat pumps which use such a device.

4 Claims, 1 Drawing Figure

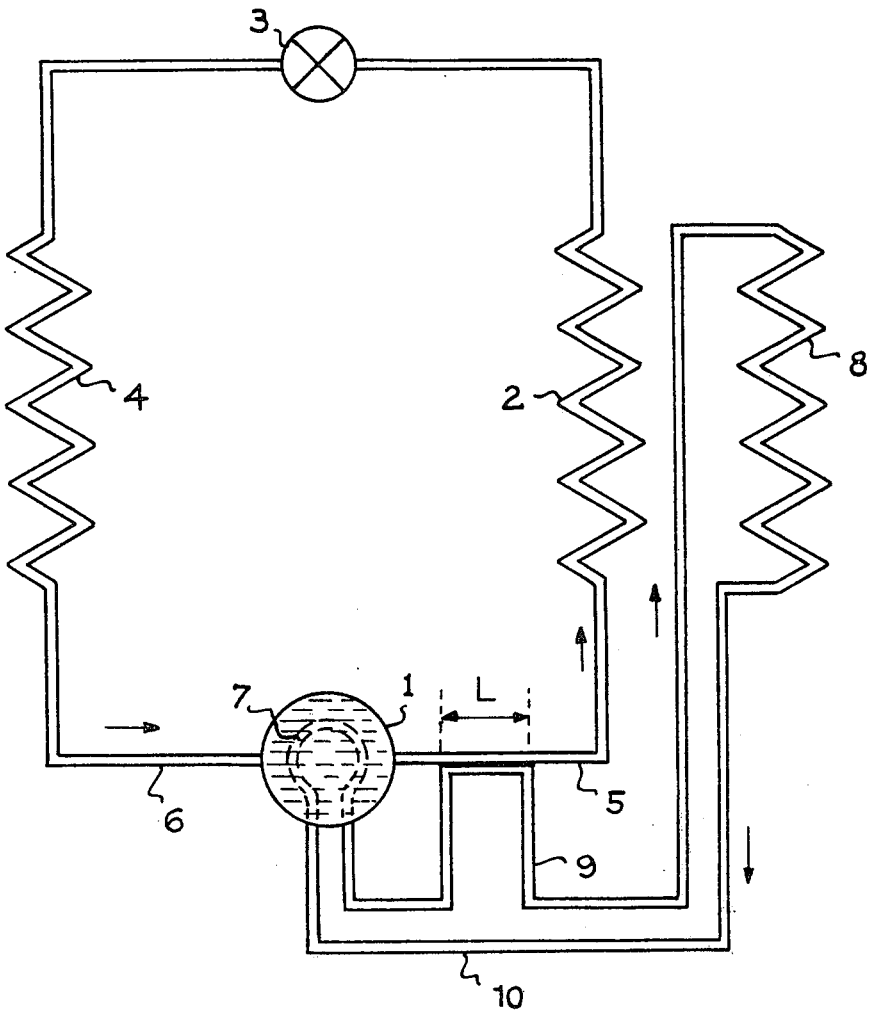
3
4
2
8
7
1
L
6
5
9
10

DEVICE FOR COOLING THE COMPRESSOR OF A THERMAL MACHINE

BACKGROUND OF THE INVENTION

The present invention relates to a device for cooling the compressor of a thermal compression machine and more particularly to a means for priming this device of the thermo-siphon type.

A conventional thermal compression machine comprises in series a compressor, a condenser, an expansion valve and an evaporator, connected together by tubes to form a closed circuit through which flows a fluid.

The fluid undergoes all along this closed circuit pressure and temperature variations. Compressed by the compressor, it is liquified inside the condenser then, after passing through the expansion valve, it is evaporated in the evaporator.

Depending on the conditions of use, a thermal compression machine may operate as a refrigerator or as a heat pump.

When the thermal machine operates as a refrigerator, the fluid is evaporated in the evaporator while yielding up cold to the environment which surrounds it and is liquified in the condenser while taking cold from the environment which surrounds it.

When the thermal machine operates as a heat pump, the fluid is evaporated in the evaporator while taking heat from the environment which surrounds it and is liquified in the condenser while restoring heat to the environment which surrounds it.

So as to avoid excessive heating of the compressor, such a compressor is equipped with a cooling circuit. This cooling circuit is advantageously formed by a thermo-siphon comprising an evaporator immersed in the oil of the compressor and a condenser, connected together by two tubes so as to form a closed circuit through which a fluid flows.

When the thermo-siphon is primed, the fluid, while evaporating in the evaporator, takes heat from the oil of the compressor, which is the object sought, and restores it to the external environment while liquifying in the condenser.

At the time of starting up the compressor, there occurs a transitory period during which the evaporation of the fluid contained in the thermo-siphon is not yet at its maximum, the evaporation only reaching its maximum when the compressor reaches its permanent operating conditions, the temperature of the oil then being substantially equal to that of the compressor.

Consequently, at the time of starting up the compressor, the cooling of the compressor is only provided gradually.

Now, so as to maintain the compressor, and consequently the whole of the installation, under good operating conditions, it is desirable, as soon as the compressor is started up, that this latter be cooled under optimum conditions.

Furthermore, the cyclic operation of the compression machine is prejudicial to maintaining the thermo-siphon under optimum operating conditions.

SUMMARY OF THE INVENTION

The present invention has as object a priming device for immediately priming the thermo-siphon as soon as the installation is brought into service.

In accordance with the invention, a device for cooling the compressor of a thermal compression machine, the compressor placed in an oil bath contained in a hermetic casing, being provided with a delivery tube and a suction tube, this cooling device of the thermo-siphon type, which comprises an evaporator immersed in the oil of the compressor and a condenser connected to the evaporator by an up-take tube and a down-take tube having at least a portion of the up-take tube subjected to the action of an auxiliary heat source permitting instantaneous priming of the thermo-siphon.

Also in accordance with the invention, the auxiliary heat source is a portion at least of the delivery tube of the compressor.

Also according to the invention, a portion of the up-take tube of the cooling device is placed in intimate contact with a portion of the delivery tube of the compressor.

BRIEF DESCRIPTION OF THE DRAWING

The present invention will be better understood from the detailed description of one embodiment taken as a non limiting example and illustrated by the accompanying drawing which shows a conventional thermal compression machine.

DESCRIPTION OF THE PREFERRED EMBODIMENT

In this drawing there is shown schematically a conventional thermal compression machine comprising in series a compressor 1, a condenser 2, an expansion valve 3, and an evaporator 4 connected together by tubes so as to form a closed circuit through which a fluid flows. Compressor 1 is connected to condenser 2 by means of a delivery tube 5 and to the evaporator 4 by its suction tube 6.

In this drawing there is also shown a circuit for cooling the compressor comprising an evaporator 7 immersed in the oil contained in the casing of the compressor (the oil being shown with broken lines), and a condenser 8 connected together by an up-take tube 9 and a down-take tube 10, so as to form a thermo-siphon through which also flows a fluid and to provide a cooling closed circuit.

The up-take tube 9 is connected to the upper part of condenser 8 and the down-take tube 10 to its lower part. Thus, the circuit of the cooling fluid is unsymmetrical and the fluid tends to circulate naturally under the effect of the thermo-siphon produced by the density variations due to the temperature variations along its path.

In known cooling devices of this type, the thermo-siphon tends to be primed with considerable delay with respect to the moment when the compressor is started up. In fact, since this compressor operates in a cyclic way, under the control for example of the thermostat of the refrigerator, the thermo-siphon has scarcely the time to be primed before the compressor stops. It operates then in a nominal way for only a few moments then stops in its turn. Thus, the cooling which is provides is irregular and mediocre.

So as to get over this disadvantage, in the device of the invention, the piping 5 where the hot gases leaving the compressor flow is placed in intimate contact over a certain length L with the up-take pipe 9 where the cooling fluid flows re-heated by the comppressor which it cools. Therefor piping 5 heats piping 9 to a considerable extent and so the cooling fluid. Under this effect, this latter tends to rise immediately and forcibly towards the top of the condenser 8 for care has been taken to place the path of pipe 9 above the compressor 1 and with a positive slope. Thus, as soon as the compressor is started up, complete and immediate priming of the thermo-siphon is obtained. This latter may then correctly cool the compressor as soon as this latter is started up.

It will be noted that the heat transfer at this position does not adversely affect the operation of the main thermal machine circuit. In fact, the hot gases coming from the compressor must be cooled so as to liquify in condenser 2 and previous cooling at the level of the contact with tube 9 only increases this effect. Similarly, the additional input of heat into the cooling circuit does not disturb this latter considering the orders of size of the means used.

A good means for providing the intimate contact between pipes 5 and 9 consists in welding them together. For domestic refrigerators, welding over a length of about 10 cm has proved to be optimal.

The cooling device of the invention may be advantageously used on all compressors equipping compression refrigerators and in particular in high acoustic insulation refrigerators. In fact, the materials used for obtaining good acoustic insulation produce as a consequence poor heat exchange with the ambient air and so poor cooling of the compressor. Since the use of the device of the invention provides instantaneous priming of the thermo-siphon, this drawback may be palliated.

What is claimed is:

1. A device for cooling a compressor of a thermal compression machine, said machine comprising:

a first hermetic circuit for circulating a first fluid, a compressor connected in said first hermetic circuit for compressing said first fluid, said compressor being placed in a second fluid contained in a hermetic casing, a first evaporator connected in said first hermetic circuit to said compressor by a delivery tube, and a first condenser connected in said first hermetic circuit to said compressor by a suction tube, said device for cooling the compressor comprising:

a second hermetic circuit of the thermo-siphon type for circulating a third fluid, a second evaporator connected in said second hermetic circuit and immersed in said second fluid, said second evaporator having two ends, a second condenser connected in said second hermetic circuit, respectively connected by an up-take tube and a down-take tube to said two ends of said second evaporator, and an auxiliary heat source for heating at least a portion of said up-take tube to obtain immediate priming of the thermo-siphon.

2. A device as claimed in claim 1, wherein said auxiliary heat source is at least a portion of said delivery tube of said compressor.

3. A device as claimed in claim 2, wherein said portion of said up-take tube is placed in intimate contact with said portion of said delivery tube of said compressor so as to ensure satisfactory heat exchange between the delivery tube, said auxiliary heat source and said up-take tube.

4. A device as claimed in claim 3, wherein said up-take tube and delivery tube portions are welded together.

* * * * *